US007452013B2

(12) United States Patent
Kachouh et al.

(10) Patent No.: US 7,452,013 B2
(45) Date of Patent: Nov. 18, 2008

(54) MOTOR VEHICLE LOCK

(75) Inventors: Checrallah Kachouh, Dortmund (DE); Markus Kothe, Velbert (DE); Markus Zillert, Duesseldorf (DE)

(73) Assignee: Brose Schliesssysteme GmbH & Co. KG (DE)

( * ) Notice: Subject to any disclaimer, the term of this patent is extended or adjusted under 35 U.S.C. 154(b) by 0 days.

(21) Appl. No.: 11/217,674

(22) Filed: Sep. 2, 2005

(65) Prior Publication Data

US 2006/0076784 A1 Apr. 13, 2006

(30) Foreign Application Priority Data

Sep. 2, 2004 (DE) ..... 10 2004 042 966

(51) Int. Cl.
*E05C 3/06* (2006.01)

(52) U.S. Cl. ..... 292/216; 292/201

(58) Field of Classification Search ..... 292/216, 292/201, DIG. 23
See application file for complete search history.

(56) References Cited

U.S. PATENT DOCUMENTS

| | | | | |
|---|---|---|---|---|
| 5,613,716 | A * | 3/1997 | Cafferty | 292/216 |
| 5,901,991 | A * | 5/1999 | Hugel et al. | 292/201 |
| 6,109,671 | A * | 8/2000 | Roncin et al. | 292/216 |
| 6,422,615 | B1 * | 7/2002 | Roos et al. | 292/216 |
| 6,773,043 | B2 * | 8/2004 | Taga | 292/341.16 |
| 7,000,956 | B2 * | 2/2006 | Fisher | 292/201 |
| 2002/0167175 | A1 | 11/2002 | Weyerstall et al. | |
| 2004/0232707 | A1 | 11/2004 | Kachouh | |

FOREIGN PATENT DOCUMENTS

| | | | |
|---|---|---|---|
| DE | 19520359 | A1 | 12/1996 |
| DE | 19614122 | A1 | 10/1997 |
| DE | 19617428 | A1 | 11/1997 |
| DE | 19617428 | C2 | 6/1998 |
| DE | 10234782 | A1 | 2/2004 |
| EP | 0978610 | B1 | 5/2003 |
| EP | 1391573 | A2 | 2/2004 |

OTHER PUBLICATIONS

English Language Abstract—DE 19520359.
English Language Abstract—DE 19617428.
English Language Abstract—DE 19614122.
English Language Abstract—DE 10234782.
English Language Abstract—EP 1391573.

* cited by examiner

*Primary Examiner*—Patricia L Engle
*Assistant Examiner*—Kristina R Fulton
(74) *Attorney, Agent, or Firm*—Andrus, Sceales, Starke & Sawall, LLP

(57) ABSTRACT

The present invention relates to a motor vehicle lock having a lock catch and a locking pawl. The lock catch may be brought into an opening position, a main locking position and a preliminary locking position. The locking pawl can be brought into a lowered and raised position. The locking pawl may be arranged to hold and release the lock catch in a direction of its opening position. A memory element is assigned to the locking pawl and arranged to keep the locking pawl in the raised position. The memory element may operate with a control apparatus. The locking pawl may be releasable by motor from the raised position and may further be moveable in a direction of its lowered position unhindered by the memory element. The release by motor of the locking pawl is controllable at a predetermined triggering time by the control apparatus.

16 Claims, 5 Drawing Sheets

MOTOR VEHICLE LOCK

BACKGROUND OF THE INVENTION

The present invention relates to a motor vehicle lock for all types of motor vehicle doors, hoods or flap locks and the like.

Today's motor vehicle locks typically have the locking elements lock catch and locking pawl arranged such that the lock catch interacts with a striker, mounted on the vehicle body, when the vehicle door is closed. The lock catch can be held by the locking pawl in a main locking position or (if available) a preliminary position when the locking pawl is in its lowered position. The lock catch has for that purpose a main locking element, and, if available, a preliminary locking element, which can be brought into engagement with a locking nose mounted on the locking pawl. Through raising the locking pawl, the lock catch is released towards its opening position. Typically, the lock catch is biased towards its opening position, whereas the locking pawl is biased towards its locked position.

For a smooth opening process it must be ensured that the locking pawl remains in the raised position until the preliminary locking element of the locking pawl has passed the locking nose of the locking pawl. If the locking pawl falls back into its lowered position too early, the locking nose of the locking pawl engages with the preliminary locking element or even with the main locking element so that the opening process is interrupted or does not start at all. Such a situation may arise if the shifting of the lock catch into the opening position is briefly obstructed, for example, because of ice buildup on the vehicle door or the vehicle tailgate being loaded with the weight of a layer of snow.

To avoid the above described interruption of the opening process, it is known from German patent application DE 195 20 359 A1 to provide a motor vehicle lock with a memory function. The memory function ensures that the locking pawl remains, during the opening process, in its raised position until the preliminary locking element of the lock catch has passed the locking nose of the locking pawl. For this purpose, the motor vehicle lock has a lever-shaped memory element typically referred to as the "snow weight lever". During the raising of the locking pawl, the memory element falls from a raised into a lowered position and thereby holds the locking pawl in its raised position. During the course of the opening process, the lock catch shifting towards its opening position presses the memory element into its raised position so that the locking pawl is ultimately released due to the forced coupling between the lock catch and the memory element. The known motor vehicle lock has an opening motor drive through which the locking pawl can be raised by means of a motor.

A similar concept is implemented in the motor vehicle lock described in German patent application DE 196 17 428 A1. Here, too, a lever-shaped memory element is provided, which is assigned to the locking pawl and keeps the locking pawl in the raised position as described above. Further, an opening motor drive is provided that interacts on the one hand with the locking pawl and on the other hand with the memory element. In addition, a pre-locking suppression system is provided, which, however, does not play a role here.

Finally, a motor vehicle lock with a memory function is known from European patent EP 0 978 610 B1 as having an elastic, lever-shaped memory element which is rigidly coupled to the locking pawl. During the raising of the locking pawl, the memory element snaps into engagement with the lock catch and, hence, keeps the locking pawl in the raised position. During the shifting of the lock catch towards its opening position the snap-on connection opens and the locking pawl is released.

It should be noted that the above-described memory function not only leads to an increase in the convenience of use, but can under certain circumstances be essential for the operation of the motor vehicle lock. By way of example, a further known motor vehicle lock (from German patent application DE 102 34 782 A1) is provided with an opening motor drive. During the opening process, the opening motor drive shifts the locking pawl initially into the raised position and then runs off block to a stop arranged on the locking pawl. The stop is in the path of the opening drive only if the locking pawl is raised. It needs to be ensured that the locking pawl remains raised until the blocking of the opening drive—which corresponds to the above-described memory function.

In all of the above described motor vehicle locks, the memory element holds the locking pawl, while in the memory state, in a raised position until the lock catch reaches its opening position. Hence, the locking pawl remains in the raised position even if the vehicle door cannot be opened due for example to the aforementioned icing. If such an obstruction should later and/or suddenly disappear, as may be the case due to melting, the vehicle door will open unexpectedly. Such unwanted behavior of the system poses a substantial accident risk.

SUMMARY OF THE INVENTION

The present invention is based on the problem of configuring and improving the known motor vehicle lock with memory function so that its operational safety is increased.

It is essential that the locking pawl can be released from the memory state by means of a motor. Accordingly, the release of the locking pawl is made possible at any time so that an undesired resting of the locking pawl in the memory state can be prevented. The release of the locking pawl by motor may be provided in addition to the above-described forced coupling, which generally causes the release of the locking pawl during the shifting of the lock catch into its opening position. According to another embodiment of the present invention, the release of the locking pawl from the memory state is exclusively provided by motor.

The release by motor of the locking pawl can be triggered at a predetermined triggering time by means of a control device of the motor vehicle lock. For example, it can be provided that the release by motor occurs at each triggering time or that the triggering depends on further conditions such as the position of the lock catch.

In one embodiment, the multiple use of the opening motor drive may be for the raising of the locking pawl by motor and/or the release of the locking pawl from the memory state by motor. Accordingly, a particular compact end product may be achieved.

In other embodiments, the memory element may be configured as a swiveling lever arrangement wherein the required force for the release of the locking pawl can be kept low.

In still other embodiments, a deformation may be provided on the memory element and/or on the locking pawl, making the raising of the memory element for the release of the locking pawl no longer necessary.

BRIEF DESCRIPTION OF THE SEVERAL VIEWS OF THE DRAWINGS

Further details, features, objectives and advantages of the present invention are explained hereinafter in more detail in view of the drawings of preferred embodiments, wherein.

DETAILED DESCRIPTION OF THE INVENTION

Figure 1:
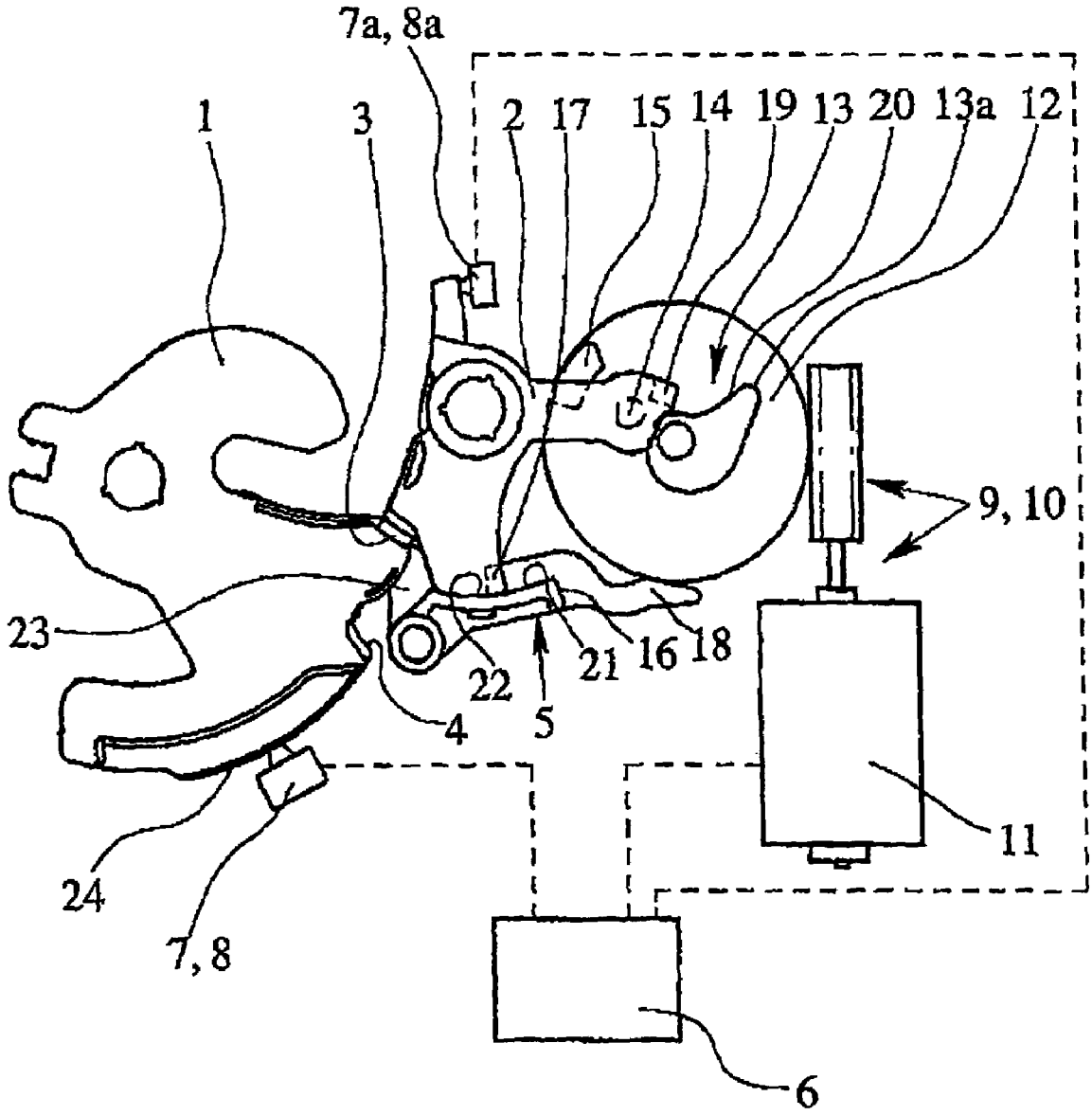
FIG. 1 depicts a motor vehicle lock according to the present invention wherein the lock catch is in the main locking position, the locking pawls is lowered, and the memory element is raised.
Figure 2:
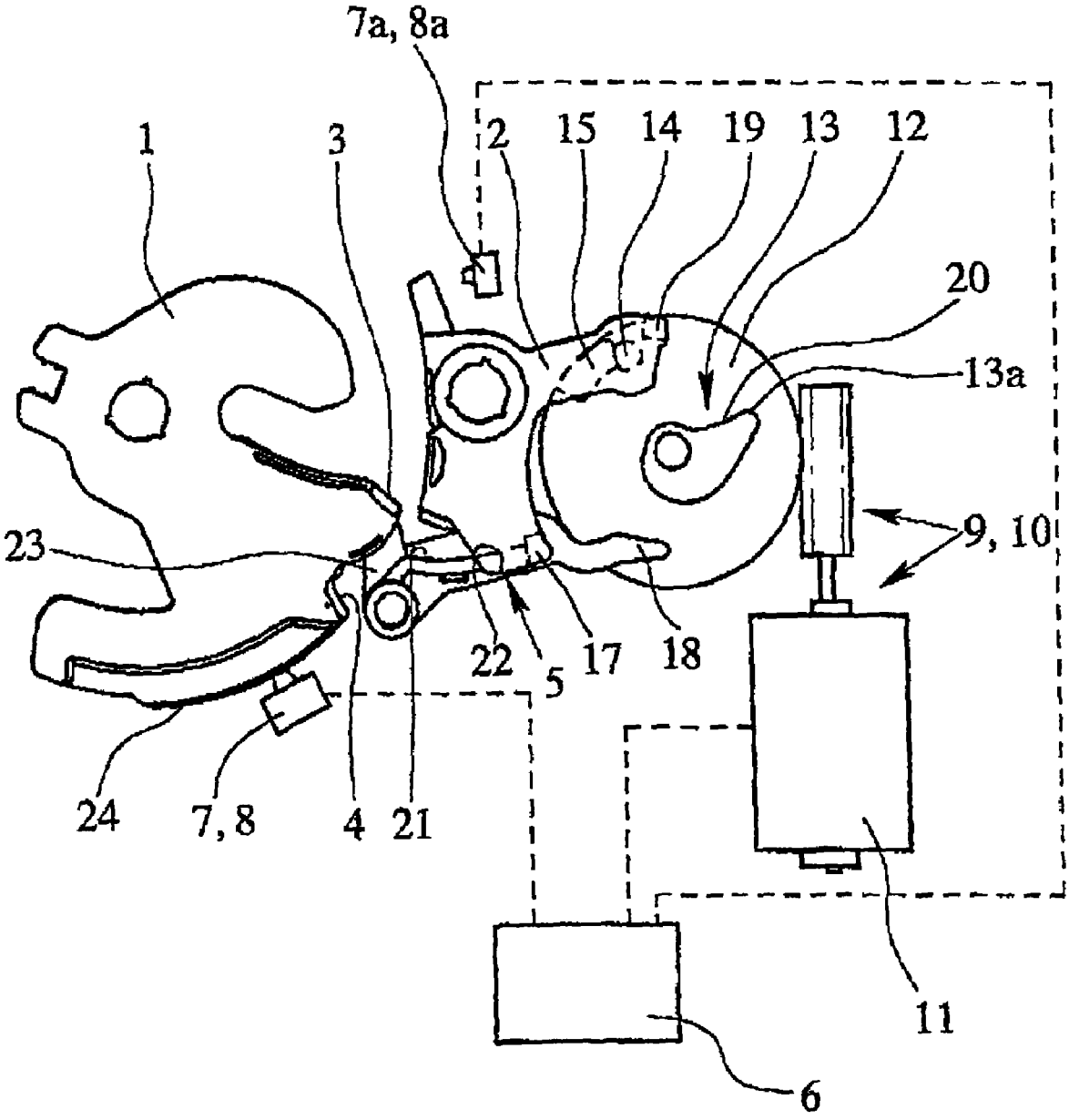
FIG. 2 depicts the motor vehicle lock according to FIG. 1, wherein the lock catch is in the main locking position, the locking pawl is raised, and the memory element is lowered.
Figure 2A:
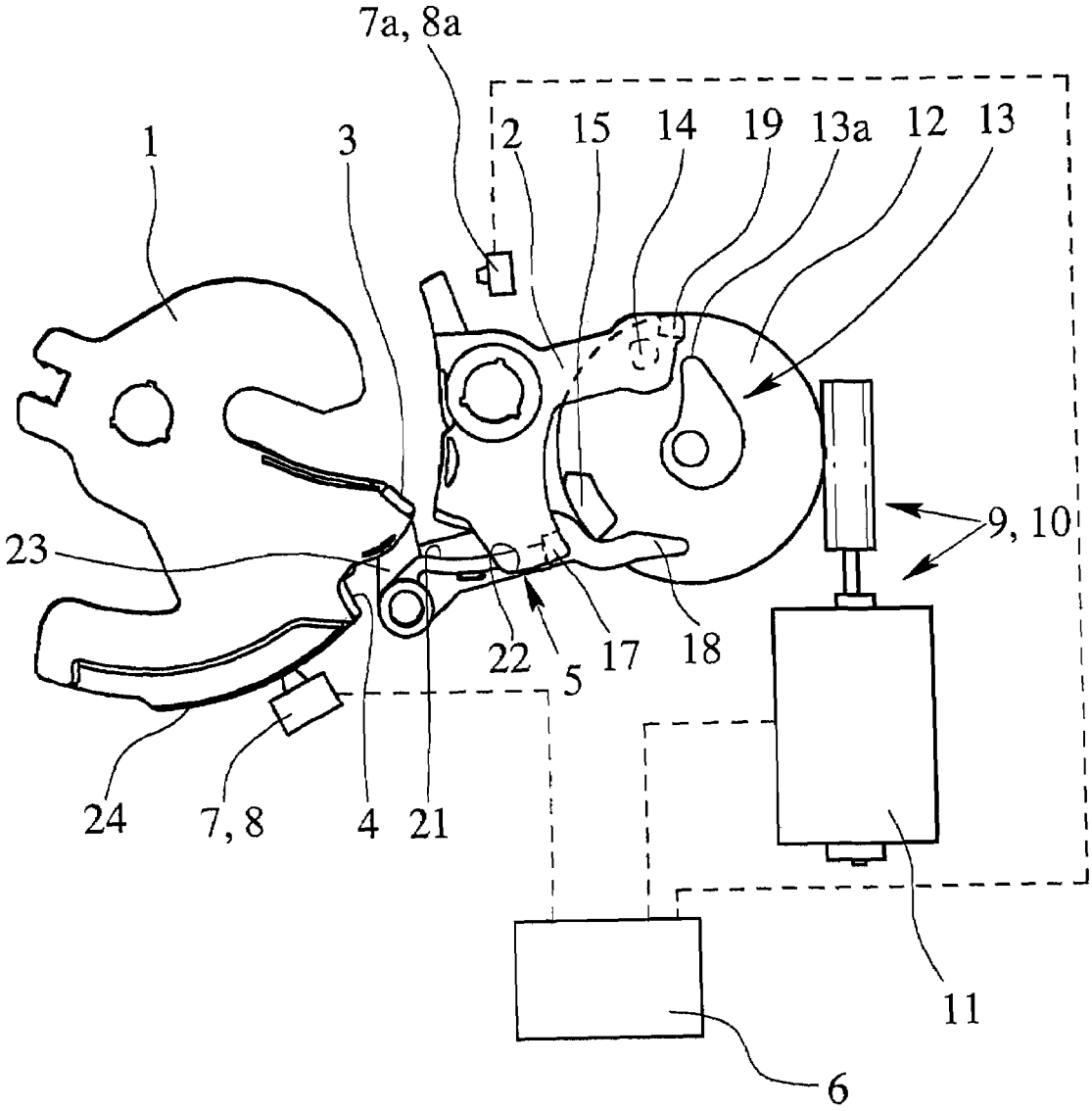
FIG. 2*a* depicts the motor vehicle lock according to FIG. 1, wherein the stop of the memory drive has just come into engagement with the control arm.

The motor vehicle lock shown in FIG. 1 comprises locking elements lock catch 1 and locking pawl 2. The lock catch 1 is arranged so as to be brought into an opening position (not shown), into the main locking position shown in FIGS. 1 and 2, and into the preliminary locking position (not shown). The lock catch 1 may be biased in a direction of its opening position—which in FIG. 1 is to the left. The lock catch 1 includes: a main lock element 3, and a preliminary lock element 4. The locking pawl 2 may be brought into a lowered position, as shown in FIG. 1, and a raised position, as shown in FIG. 2. As depicted in FIG. 1, the locking pawl 2, in its lowered position, holds the lock catch 1 in a main locking position as well as in a preliminary locking position. The locking pawl 2, as depicted in FIG. 2 in its' raised position, releases the lock catch 1 in the direction of its opening position.

A memory element 5 is assigned to the locking pawl 2 and is arranged to hold the locking pawl 2 in the raised position after the locking pawl 2 has been raised. The raised position corresponds with the afore mentioned memory state depicted in FIG. 2.

The locking pawl 2 may be raised by a motor, wherein the process of raising occurs in a blocking operation. In the raised position, the locking pawl 2 has a corresponding blocking effect, such that it needs to be ensured that the locking pawl 2 remains a sufficiently long period of time in its raised position. This is ensured by means of the memory element 5.

The memory state is maintained so long as a further operational state of the motor vehicle lock is reached. In one embodiment, depicted in FIGS. 1 to 4, the further operational state is reached when the lock catch 1 has reached its opening position. This is preferably ensured through a corresponding forced coupling between the lock catch 1 and the memory element 5, as will be described in more detail below. Such a further operational state may additionally be further defined by means of a certain control state, as will also be described below.

To control electrical functions of the motor vehicle lock as those set out above, such as providing an opening function, a power lock function, or the like, the motor vehicle lock includes a control apparatus 6 which is positioned either within or outside the motor vehicle lock itself located within the motor vehicle. In the figures, the control apparatus 6 is depicted schematically.

The locking pawl 2 may be released from the memory state, shown in FIG. 2, by means of a motor. The locking pawl 2 may then, unhindered by the memory element 5, be shifted in the direction of its lowered position. The locking pawl 2 may be biased in the direction of its lowered position so that it essentially snaps in the direction of its lowered position after release.

The release, by motor, of the locking pawl 2, may be triggered at a predetermined triggering time by means of the control apparatus 6. The triggering time may be defined as the end of a predetermined period of time which starts with the raising of the locking pawl 2. The release, by motor, of the locking pawl 2, then occurs, in principle, for example a few seconds after the raising of the locking pawl 2.

In one embodiment, the triggering time is defined as the time of a signal transmission from the rest of the motor vehicle's electrical system to the control apparatus 6 following the raising of the locking pawl 2. This signal transmission may, for example, occur during the engaging of the ignition or the starting the motor vehicle.

As described above, it may be provided that the triggering of the release by motor of the locking pawl 2 occurs in principle at each triggering time, hence, after each raising of the locking pawl 2.

In another embodiment, the triggering of the release by motor of the locking pawl 2 occurs selectively, namely, not every triggering time causes a corresponding triggering. For this purpose, a lock catch monitor 7 is assigned to the control apparatus 6 for monitoring the position of the lock catch 1. The lock catch monitor 7, depicted in FIGS. 1 and 2, includes a simple spring-biased switch 8 which indicates to the control apparatus 6 the swiveling of the lock catch 1 into the opening position. Numerous sensors, known in the art, may be used as the lock catch monitor 7. One mode of operation may be achieved if the control apparatus 6 triggers the release by motor of the locking pawl 2 from the memory state when the lock catch 1 has not yet fully reached its opening position, this being between the time of raising the locking pawl 2 and the triggering time. This is the above-described error state, namely, when the shifting of the lock catch 1 in the direction of its opening position is obstructed due, for example, to icing.

The lock catch monitoring 7 does not necessarily have to occur directly at the lock catch 1. For example, the opening of the vehicle door may indirectly provide information about the shifting of the lock catch 1 into its opening position. This is in so far advantageous as the vehicle door is usually equipped with an AJAR switch.

In another embodiment, the release by motor of the locking pawl 2 is also selectively controlled. Accordingly, a locking pawl monitor 7*a* for monitoring the position of the locking pawl 2 is provided. The monitor 7*a* is arranged to be polled by the control apparatus 6. The locking pawl monitor 7 further comprises a simple spring-biased switch 8*a* that reports the swiveling of the locking pawl 2 into the raised position to the control apparatus 6. If the locking pawl 2 at the triggering time, which may be the time of raising the locking pawl 2, is still in its raised position, the above error state exists and the control apparatus 6 triggers the release by motor of the locking pawl 2. A particular reliable monitoring result can be achieved if, in addition, the above-mentioned lock catch monitoring 7 is polled.

In view of the above, the release by motor of the locking pawl 2 is particularly advantageous in connection with the above-mentioned forced coupling between lock catch 1 and memory element 5. Through this forced coupling a shifting of the lock catch 1 into the opening position causes in principle a release of the locking pawl 2 from the memory state. The forced coupling on one side and the release by motor of the locking pawl 2 on the other side are measures that complement one another.

If, in the error state, the shifting of the lock catch 1 after raising the locking pawl 2 into the opening position is obstructed, the forced coupling between lock catch 1 and memory element 5 is not effective, whereby the locking pawl 2 remains in its raised position. Through the timely caused release, by motor, of the locking pawl 2, a sudden opening of the vehicle door is prevented after the obstruction disappears, for example, after the melting of the ice of a previously iced vehicle door. After its release, the locking pawl 2 falls back into the main lock element 3, or in any case into the path of movement of the preliminary lock element 4 of the lock catch 1, in so far as the lock catch 1 is not already shifted substantially in the direction of its opening position.

For the release by motor of the locking pawl 2, a memory drive 9 is provided which may advantageously be configured as an additional drive depending upon use. In another embodiment, an already existing drive is used as memory drive 9. In the illustrated embodiment, the motor vehicle lock has an opening drive 10 for raising the locking pawl 2 by motor, which at the same time takes on the function of the memory drive 9. A power lock drive or an auxiliary lock drive may also serve such a double use.

As shown in FIG. 1, the opening drive 10 has a positioning element 12 driven by a motor 11. The positioning element 12 has a control contour 13 that can be brought into engagement with an attachment 14 at the locking pawl 2. For raising the locking pawl 2, the positioning element 12 is turned from the position shown in FIG. 1 to the right until the control contour 13 engages with the attachment 14 and the locking pawl 2 swivels to the left.

The memory element 5 can be brought into a lowered position, as depicted in FIG. 2, such that the memory element 5 holds the locking pawl 2 in its raised position. Further, the memory element 5 can be brought into a raised position, as depicted in FIG. 1, wherein the memory element 5 releases the locking pawl 2.

Since the memory element 5 is biased towards its lowered position, raising the locking pawl 2 through the opening drive 10 causes the shifting of the memory element 5 into its lowered position. This is depicted in FIG. 2.

During the raising of the locking pawl 2 by means of the opening drive 10, the attachment 14 is shifted into the path of movement of a stop 15 provided on the positioning element 12. Since the memory element 5 holds the locking pawl 2 in this position, the block operation for the opening drive 10 is at the same time ensured.

As shown in FIG. 1, the memory element 5 is configured as a swiveling lever arrangement. The memory element 5 may however be configured as a linearly movable slide or the like.

For the implementation of the above-described memory state, the memory element 5 has a stop 16 that can be brought into engagement with a counter stop 17 provided on the locking pawl 2. Further, the memory element 5 has a control arm 18 whose swiveling (to the right in FIG. 1) causes the relocating of memory element 5 into the raised position.

As depicted in FIG. 2, the control arm 18 is in the memory state and in the path of the stop 15 provided on the positioning element 12. Turning the positioning element 12 from the position shown in FIG. 2 to the left causes the control contour 13 with its partial contour 13*a* to pass the attachment 14 and urge the locking pawl 2 briefly into a super stroke position. For that purpose, the partial contour 13*a* has a corresponding slant. Turning the positioning element 12 further causes the stop 15 to engage control arm 18 and shift the memory element 5 to the right and into its raised position. The locking pawl 2 is thereby released and now snaps in the direction of its lowered position, depicted as being to the right in FIG. 2. A stop 19 provided on the locking pawl 2 finally enters the path of a hub 20 of the control contour 13 and blocks further movement of the opening drive 10, so that the release by motor of the locking pawl 2 is further ensured in the blocking operation.

Since after the above-described process of release by motor of the locking pawl 2 the locking pawl 2 is swiveled in the direction of its lowered position, and the stop 15 provided on the positioning element 12 has been disengaged with the memory element 5, a hub 21 of the memory element 5 falls on a corresponding hub 22 of the locking pawl 2. Accordingly, the memory element 5 is held in its raised position until the locking pawl 2 is raised again by the opening drive 10. While the memory element 5 is in the raised position, the control arm 18 of the memory element 5 is not in engagement with the memory drive 9, i.e., with the opening drive 10. This allows the above-described double use of the opening drive 10 without additional constructional expenditure.

As set out above, according to a preferred embodiment, a non-motor release of the locking pawl 2 from the memory state is ensured when the lock catch 1, after raising the locking pawl 2, swivels into its opening position representing regular normal operation. For that purpose, the memory element 5 has a further control arm 23 that engages with a control contour 24 on the lock catch 1 in the memory state while the control contour 24 shifts into its opening position, wherein the resulting swiveling of the control arm 23 (to the right in FIG. 2) leads to a raising of the memory element 5, i.e. forced coupling.

Figure 3:
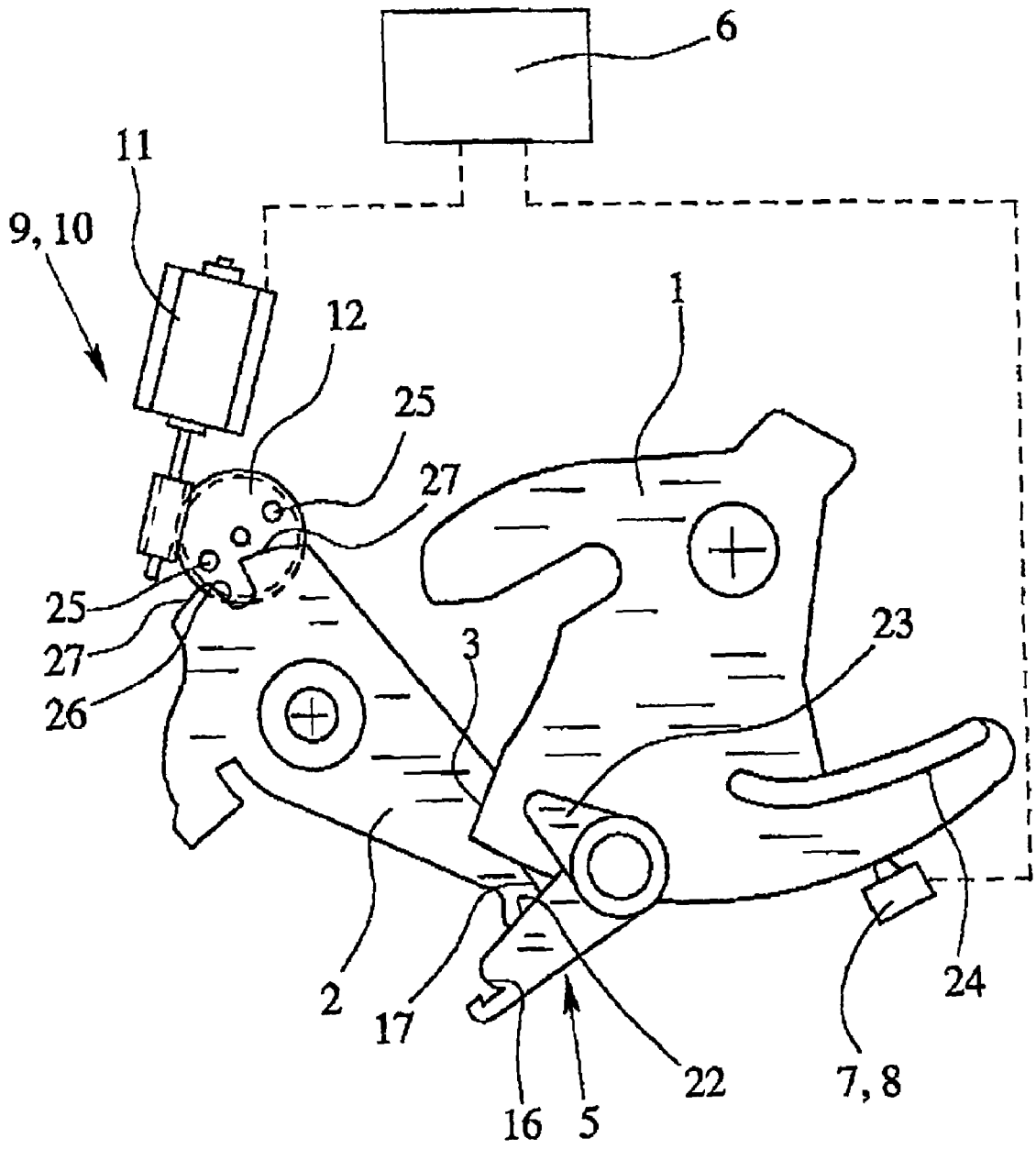
FIG. 3 depicts a motor vehicle lock according to the present invention in a further embodiment, wherein the lock catch is in the main locking position, the locking pawl is lowered, and the memory element is raised.
Figure 4:
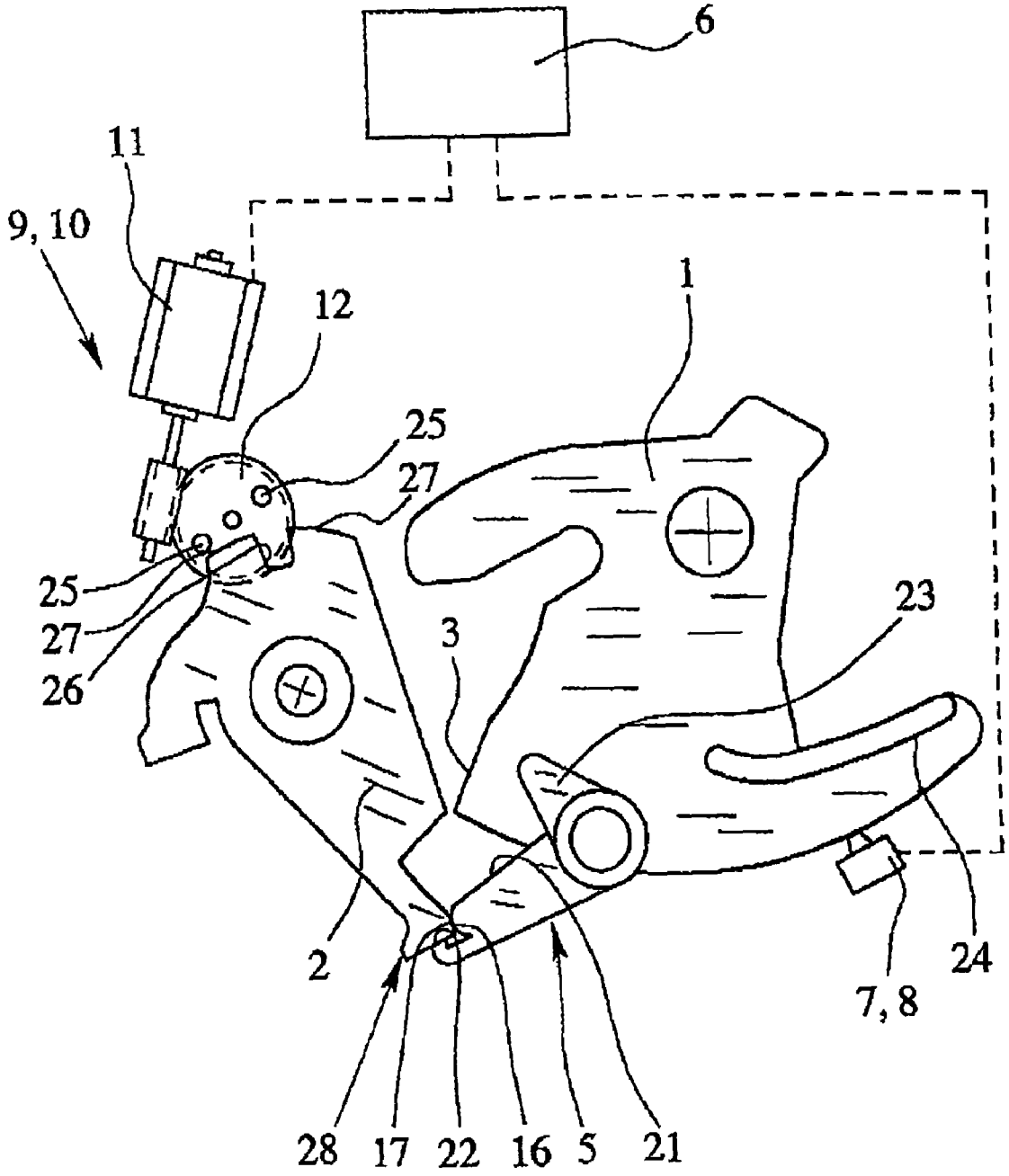
FIG. 4 depicts the motor vehicle lock according to FIG. 3, wherein the lock catch is in the main locking position, the locking pawl is raised, and the memory element is lowered.

A further preferred embodiment of a motor vehicle lock with the above-described memory function is shown in FIGS. 3 and 4. Corresponding components depicted in the figures have the same reference numerals.

The motor vehicle lock illustrated in FIGS. 3 and 4 comprises the locking elements lock catch 1 and locking pawl 2 that interact in the above-described manner. However, the lock catch 1 of FIGS. 3 and 4 has only a main lock element 3 and no preliminary lock element.

FIG. 3 depicts the lock catch 1 in the main locking position with a lowered locking pawl 2. In contrast, FIG. 4 depicts the locking pawl 2 in its raised position. In the raised position, the locking pawl 2 is held by a memory element 5. The lock catch 1 remains unchanged in its main locking position and is, however, not engaged with the locking pawl 2.

The memory element 5 is also configured as a swiveling lever arrangement. However, only a single control arm 23 in the above sense is provided. The lock catch 1 engages with the control arm 23 during its shifting from the position shown in FIG. 4 to the right into its opening position, and turns the control arm 23, in FIG. 4, to the left—which corresponds to the above-mentioned forced coupling. This leads to a shifting of the memory element 5 into the raised position. For this engagement with the memory element 5, the lock catch 1 has a control contour 24. As described above, raising the memory element 5 releases the locking pawl 2.

Aside from the above release of the locking pawl 2 provided in regular operation, a release by motor of the locking pawl 2 is also provided. For the release by motor of the locking pawl 2, a memory drive 9 is provided that can be configured as an additional drive or as an already existing drive. In the embodiment illustrated in FIGS. 3 and 4, an opening drive 10 is again provided which is at the same time also the memory drive 9. The opening drive 10 has a motor 11 and a positioning element 12 which is provided with two pegs 25. The locking pawl 2 has a recess 26 and stop surfaces 27 which allow a shifting of the locking pawl 2 in the direction of engagement and in the direction of raising. At the same time, the stop surfaces allow implementation of a blocking operation.

Of particular importance is that the locking pawl 2 can be shifted from the position shown in FIG. 4—from the memory state—by means of the opening drive 10 with an increased force in direction of its lowered position. In a particularly preferred embodiment, the memory element 5 is a lever arrangement made at least partially of plastic, which buckles, bends, or the like, in the memory state (depicted in FIG. 4), due to the above increased force, so as to cause the release of the locking pawl.

Conversely, it can be provided that the locking pawl 2 has an engagement element 28 for the engagement with the memory element 5. The engagement element 28 is preferably made of plastic and buckles, bends, or the like, in the memory state due to the above increased force thereby causing the release of the locking pawl 2.

In the embodiment shown in FIGS. 3 and 4, raising the memory element 5 for the release by motor of the locking pawl 2 is not necessary, but rather a deforming of the memory element 5 and/or the locking pawl 2 with an increased force which is here provided by the opening drive 10.

The above deformation can be an elastic or non-elastic deformation. In any case, the deformable element needs to be configured so that the locking pawl 2 is, during regular operation, held in the raised position by the memory element 5 and that only after the release by motor of the locking pawl 2, i.e., under an increased force, a corresponding deformation is caused that releases the locking pawl 2.

In this further embodiment, the release by motor of the locking pawl 2 from the memory state encompasses, therefore, the shifting by motor of the locking pawl 2 under increased force in the direction of its lowered position. Due to the increased force, the memory element 5 and/or the locking pawl 2 deform at least partially which ultimately causes the release of the locking pawl 2.

The deformability of the memory element 5 on one side and/or the locking pawl 2 on the other side can be supported by a special design of these components. For example, the memory element and/or the locking pawl 2 may have, at least in sections, a substantially arc-shaped and therefore flexible design. Alternatively, the memory element 5 as a whole may have an arc shape which provides for the desired flexibility of the memory lever 5 in combination with the parameters of its material.

For advantageous variations of the embodiment shown in FIGS. 3 and 4 reference is made to the above description of the embodiments shown in FIGS. 1 and 2.

What is claimed is:

1. A motor vehicle lock, comprising:

a lock catch arranged to be positioned in at least one of an opening position, main locking position, and preliminary locking position;

a locking pawl arranged such that in a lowered position the locking pawl holds the lock catch in at least one of the main locking position and preliminary locking position and in a raised position the locking pawl releases the lock catch in a direction of the opening position, a memory element assigned to the locking pawl for realizing a memory state and arranged to maintain the memory state and with it to maintain the locking pawl in a raised position after the locking pawl has risen and until a further functional state of the motor vehicle lock is reached, a control apparatus positioned within or outside of the vehicle lock and within the motor vehicle, the control apparatus arranged to control individual functions of the motor vehicle lock, wherein the locking pawl is releasable by motor from the memory state and then moveable in the direction of its lowered position unhindered by the memory element, and the control apparatus is arranged to control the release by motor of the locking pawl at a predetermined triggering time;

a memory drive for the release by motor of the locking pawl;

wherein the memory element further comprises a first control arm, the first control arm being arranged to be turned in a direction which causes a shifting of the memory element into the raised position thereof, in which the locking pawl is released from the memory state, and the first control arm is further arranged to engage or be brought into engagement with the memory drive such that the first control arm may be swiveled by motor into its raised position;

wherein the memory element further comprises a second control arm arranged such that the lock catch engages the second control arm in the memory state of the memory element during shifting of the lock catch into its opening position, and wherein a resulting turning of the control arm leads to a raising of the memory element into its raised position, in which the locking pawl is released from the memory state.

2. The motor vehicle lock according to claim 1, wherein the triggering time is an end of a predetermined period of time starting from the raising of the locking pawl.

3. The motor vehicle lock according to claim 1, wherein the triggering time is the time of a signal transmission occurring after the raising of the locking pawl from an electrical system of the motor vehicle to the control apparatus.

4. The motor vehicle lock according to claim 1, further comprising:

at least one of a lock catch monitor and a locking pawl monitor assigned to the control apparatus and arranged such that the lock catch monitor is arranged to monitor a position of the lock catch and the locking pawl monitor is arranged to monitor a position of the locking pawl, and wherein the control apparatus is arranged to trigger, at the triggering time, the release by motor of the locking pawl in dependence of at least one of the lock catch monitor and the locking pawl monitor.

5. The motor vehicle lock according to claim 4, wherein the control apparatus is arranged to trigger the release by motor of the locking pawl if the lock catch has, from the time of raising the locking pawl until the triggering time, not yet completely reached its opening position.

6. The motor vehicle lock according to claim 4, wherein the control apparatus is arranged to actuate the release by motor of the locking pawl if the locking pawl at the triggering time is in the raised position and if at substantially the same time the lock catch has not yet completely reached its opening position.

7. The motor vehicle lock according to claim 1, wherein the lock catch is coupled with the memory element such that a shifting of the lock catch into the opening position causes the release of the locking pawl from the raised position.

8. The motor vehicle lock according to claim 1, further comprising an opening drive provided for raising by motor the locking pawl, and wherein the opening drive is at substantially the same time the memory drive.

9. The motor vehicle lock according to claim 1, wherein the memory element is arranged to be brought into a lowered position whereby the memory element holds the locking pawl in its raised position, and wherein the memory element is arranged to be brought into a raised position whereby the memory element releases the locking pawl.

10. The motor vehicle lock according to claim 9, wherein the memory element is biased towards its lowered position.

11. The motor vehicle lock according to claim 1, wherein the memory element comprises a swiveling lever arrangement.

12. The motor vehicle lock according to claim 1, wherein the first control arm engages the memory drive exclusively when the memory element is in the lowered position.

13. The motor vehicle lock according to claim 1, wherein the memory element is a lever arrangement comprising plastic material arranged to at least one of buckle and bend in the memory state due to an increased force so as to cause the release of the locking pawl.

14. The motor vehicle lock according to claim 1, wherein the locking paw comprises an engagement element arranged to engage the memory element, the engagement element comprising plastic material arranged to at least one of buckle and bend in the memory state due to an increased force so as to cause the release of the locking pawl.

15. The motor vehicle lock according to claim 13, wherein the release by motor of the locking paw comprises a shifting by motor of the locking pawl under increased force in a direction of its lowered position, whereby at least one of the memory element and the locking pawl deform so as to cause the release of the locking pawl.

16. The motor vehicle lock according to claim 13, wherein at least one of the memory element and the locking paw comprise at least a sectioned substantially arc-shaped design.

* * * * *